US006708007B2

(12) United States Patent
Yamaguchi

(10) Patent No.: US 6,708,007 B2
(45) Date of Patent: Mar. 16, 2004

(54) IMAGE FORMING APPARATUS AND IMAGE FORMING METHOD

(75) Inventor: Seiji Yamaguchi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/106,189

(22) Filed: Mar. 27, 2002

(65) Prior Publication Data

US 2002/0146252 A1 Oct. 10, 2002

(30) Foreign Application Priority Data

Mar. 28, 2001 (JP) ..... 2001-093329

(51) Int. Cl.[7] ..... G03G 15/00
(52) U.S. Cl. ..... 399/30; 399/58
(58) Field of Search ..... 399/27, 28, 30, 399/53, 58, 88, 59

(56) References Cited

U.S. PATENT DOCUMENTS 5,202,769 A * 4/1993 Suzuki ..... 399/58
5,581,326 A * 12/1996 Ogata et al. ..... 399/30

FOREIGN PATENT DOCUMENTS

JP 58-130354 * 8/1983
JP 11-95625 A * 4/1999

* cited by examiner

*Primary Examiner*—Joan Pendegrass
(74) *Attorney, Agent, or Firm*—Fitzpatrick, Cella, Harper & Scinto

(57) ABSTRACT

An image forming apparatus for controlling a toner supply includes a density detecting component for detecting a density of toner in a developer when forming an image, a toner supply component for supplying toner during image formation in an amount determined by a first toner density detected by the density detecting component, an image forming component for forming an image with toner supplied from the toner supply component in accordance with the toner density detected by the density detecting component, and a storage component for storing a second toner density detected by the density detecting component in preparation for forming a second image after forming a first image, the toner supply component shutting off power to the image forming apparatus after supply of toner to the image forming apparatus using the second toner density stored in the memory is completed when power to the image forming apparatus is switched OFF.

20 Claims, 10 Drawing Sheets

IMAGE FORMING APPARATUS AND IMAGE FORMING METHOD

FIELD OF THE INVENTION

The present invention relates generally to an image forming apparatus such as an electrophotographic or electrostatic recording-type copier, printer or the like that adheres a developer to a potential image formed on an image carrying medium so as to turn the potential image into a visible image, and more particularly, to an image forming apparatus equipped with a developer control unit for adjusting the density of a two-part toner, and an image forming method thereof.

BACKGROUND OF THE INVENTION

Generally, in a developing apparatus equipped with an electrophotographic or electrostatic recording-type image forming apparatus, a two-part developer consisting of toner particles and carrier particles is used. Particularly with color image forming apparatuses that use electrophotography to form a full color or multi-color image, most of the developing apparatuses use a two-part developer.

FIG. 1 shows a schematic cross-sectional view of a conventional two-part developing apparatus. Numeral 10 denotes a developer container; numeral 2 denotes the developing sleeve. The developing sleeve 2 is an empty metallic sleeve, within which is contained a magnetic roller 3 that constitutes a magnetic field generating means. Two agitation devices that are screws A and B are arranged inside the developer container 10. The A screw 5 is disposed substantially parallel to the developing sleeve 2, with B screw 6 disposed on the opposite side of A screw 5, away from the developing sleeve 2.

FIG. 2 shows a plan view of a conventional developing apparatus. As shown in the diagram, the A screw 5 and the B screw 6 are disposed substantially parallel to each other in a latitudinal direction, with an inner wall 7 is disposed between the A screw 5 and the B screw 6 so as to prevent the developer from getting directly in between the two screws A and B. It will be noted that the inner wall 7 does not extend all the way to the longitudinal ends, so that the developer is able to travel between the two screws A and B. The two screws A and B are set to churn the developer in opposite directions. A gear not shown in the diagram connects the developing sleeve and the two screws A and B. When the developing sleeve 2 rotates, the developer circulates continuously within the container in the direction of the arrows.

As is commonly known, the toner density of a two-part developer, that is, the ratio of the weight of the toner particles to the total weight of the carrier particles and toner particles combined is an extremely important factor in stabilizing the image quality. The developer toner particles are consumed during development, so the toner density changes. As a result, it is necessary to use a toner density control unit (ATR) to detect the developer toner density accurately in a timely manner and to replenish the toner as the density changes in order to maintain the toner density at a uniform level and thereby to maintain the quality of the image.

In order to compensate for these changes in the density of the toner inside the developing apparatus as the developing process progresses, it is necessary to control the amount of toner supplied to the developing apparatus. Toward this end, a variety of systems have conventionally been used for the toner density detection apparatus and the density control apparatus.

For example, there are developer density control apparatuses that make use of the fact that the reflectance of light brought near to the developer holder (typically a developing sleeve is often used for this purpose, so hereinafter the developer holder is referred to as the "developing sleeve"), or a developer transport path of the developer container and directed onto transported developer located atop the developing sleeve or the developer inside the developer container differs according to the toner density to detect and control the toner density. Additionally, there are inductance detection-type developer density control apparatuses that use detection signals from an inductance head that detects a nominal magnetic permeability from the relative proportions of the magnetic carrier and the nonmagnetic toner sticking to the side walls of the developer container and converts the detected magnetic permeability into an electrical signal in order to detect the actual density of the toner inside the developer container, and to supply toner based on a comparison of the detected density with some reference value.

Additionally, there are systems in which a patch image density formed on an image retaining body (typically a photosensitive drum is often used for this purpose, so the image retaining body is hereinafter is referred to as a "photosensitive drum") is acquired by a sensor that receives light directly or via reflection from a light source disposed opposite the surface of the photosensitive drum, the acquired patch image density is converted to a digital signal by an analog-digital converter and transmitted to a CPU, and the CPU then cuts off the supply of toner until the indicated reading returned to an initial preset value if the read density is higher than such initial preset value, as a result of which the toner density is maintained indirectly at a desired value.

However, there is a drawback to the system for detecting toner density from the reflectance of light directed onto either the transported developer located atop the developing sleeve or the developer inside the developer container, in that accurate toner density readings cannot be obtained if the toner dirties the detecting means.

Similarly, there is a drawback to the inductance detection-type ATR, in that the sensor detection signals change discontinuously due to changes in the apparent density of the developer due to fluctuations in the disposition and environment directly before the image forming apparatus stops operation and directly after the image forming apparatus recommences operation.

Similarly, there is a drawback to the system for controlling toner density indirectly from the patch image density, in that if the patch density measurements are taken too infrequently the intervening toner densities cannot be gauged accurately, whereas if the measurements are taken too frequently the print is interrupted and consequently the number of sheets of paper output cannot be accurately determined. Additionally, as the image forming apparatus is made compact, the space needed to form the patch image or provide the detecting means cannot be retained.

Accordingly, as a method that eliminates the above-described drawbacks, a toner supply system that utilizes a video count has been commercialized.

According to such a system, in order to maintain the toner density at a constant level inside the developer container as the density decreases through developing, the output levels of the digital image signals of each of the pixels are integrated to obtain a print ratio for the image, which is used to calculate the amount of toner to be consumed and thus to be supplied. In other words, from the signals input to a laser scanner or other such exposure device, the exposure output level for each of the pixels is integrated, converted to a video count factor and then transmitted to the CPU. The CPU converts the video count factor to a supply volume, transmits a toner supply signal to activate a toner supply unit, and supplies the required amount of toner to the interior of the developer container, thus maintaining the density of the toner inside the developer container at a constant level.

FIG. 3 is a flowchart of steps in the conventional process of video count-based toner supply, and FIG. 4 is a corresponding timing chart thereto. The main power supply indicates the ON-OFF status of the main power supply for the image forming apparatus, and the print operation denotes the status of operations relating to the image output (S806). The developer unit rotation refers to the rotational state (S807) of the developing sleeve and agitation devices. The exposure device drive refers to a state (S808) in which an exposure device illuminates an image on a photosensitive drum. The video count acquisition refers to a state (S809) in which video count information is acquired from the exposure device for the purpose of determining the amount of toner to be supplied. The toner supply indicates steps (S811, S812) of driving a toner supply unit and supplying a required amount of toner to the developer container.

Once power is supplied to the main unit of the image forming apparatus and predetermined start-up preparations are completed, the image forming apparatus enters a standby state. When the image forming apparatus in such standby state receives a print signal, the image forming apparatus commences printing, activating in order the photosensitive drum, the charge device, the exposure device and so on. The developing apparatus remains stopped in a standby state until the timing needed for developing the image arrives and operates only when developing the image, rotating the developing sleeve and the screws. Then, video count measurements are carried out simultaneously with the activation of the exposure device, thus calculating the amount of toner to be supplied for the next printing operation.

At the next printing operation, toner supply is carried out based on the amount of toner supplied as calculated on the basis of the video count taken during the previous printing, thus maintaining the density of the toner inside the developing container at a constant level.

However, the above-described operations can give rise to the following problems.

First, since the video count is carried out while monitoring the exposure state of the exposure device, the measurement time lasts approximately as long as the processing time for the image forming apparatus, after which toner supply is carried out, which means that the timing of the rotation of the developing sleeve of the developing apparatus falls out of synch with the timing of the image forming apparatus. As a result, the supply of toner is always at least one page behind the printing. When that happens, those systems which store data on the toner supply amount in the RAM of the image forming apparatus lose that data when the power to the image forming apparatus is switched OFF and the RAM is reset, leading to a situation in which no toner is supplied to the first sheet to be printed after the power is turned ON again. In extreme cases, no toner is supplied at all if, repeatedly, only a single page is printed before the power is shut OFF once more.

Providing the image forming apparatus with a nonvolatile memory and recording in that memory the data needed to supply an amount of toner to the first page to be printed after the power is again turned ON can solve such a disadvantage. In most cases, however, by the time the power is turned on again the developer has been left to harden into a mass, so ordinarily the agitation device is first rotated in a warm-up operation in order to loosen the developer, and as a result the toner that should have been supplied for the first page of printing has already been ejected from the toner supply aperture during warm-up while a new supply of toner has not yet been delivered. The upshot is that there is no or insufficient toner left for the printing of the first page.

Another difficulty is that if the toner is delivered in a bunch to the dried-out developer, the toner and the developer will not be properly mixed and the charge will be unevenly distributed.

Additionally, in those image forming apparatuses in which the developing apparatus is in the form of a replaceable cartridge, it is always possible that the toner cartridge will be replaced while the power is OFF, which means that a completely unrelated toner supply may be conducted from a separate cartridge.

SUMMARY OF THE INVENTION

The present invention has been proposed to solve the problems of the conventional art, and has as its object to provide an image forming apparatus and an image forming method for a developer density control system that requires that toner supply be deferred until the next image formation operation whenever the amount of toner required to be supplied cannot be determined and the supply of toner cannot be completed within the time required for a single sheet to be printed, in which a special toner supply mode is executed whenever the power to the image forming apparatus is switched OFF such that the supply of toner is completed before the main power is switched OFF.

As a result of the execution of this special toner supply mode prior to the shutdown of power to the image forming apparatus, a situation in which too little toner or no toner at all is supplied during warm-up can be prevented because the image forming apparatus is continuously monitoring and adjusting the toner density so as to obtain optimum density levels.

The above-described object of the present invention is achieved by an image forming apparatus for controlling a toner supply, comprising:

density detecting means for detecting a density of toner in a developer when forming an image;

toner supply means for supplying toner during image formation in an amount determined by a first toner density detected by the density detecting means and stored in a memory;

image forming means for forming an image with toner supplied from the toner supply means in accordance with the toner density detected by the density detecting means and stored in the memory; and storage means for storing in the memory a second toner density detected by the density detecting means in preparation for forming a second image after forming a first image, the toner supply means shutting off power to the image forming apparatus after supply of toner to the image forming apparatus using the second toner density stored in the memory is completed when power to the image forming apparatus is switched OFF.

Preferably, the above-described image forming apparatus is one in which the density detecting means calculates a toner density decrease by determining the amount of toner consumed using a video count that integrates a number of laser drive clock pulses that correspond to a respective plurality of pixel densities of each image to be formed.

Preferably, the image forming apparatus is one in which the image forming means forms an image corresponding to color elements including yellow (Y), magenta (M), cyan (C) and black (Bk) in order to form a color image.

Preferably, the image forming apparatus is one in which the image forming means comprises:

an electrostatic potential image forming means for forming an electrostatic potential image, the electrostatic potential image forming means comprising:

charging means for charging the electrostatic potential image forming means so as to form the electrostatic potential image; and developing means comprising:

a developer container for containing a two-part developer consisting of a toner and a carrier;

an agitation device for agitating the developer inside the developer container; and a developer sleeve for holding and transporting the agitated developer to a developing unit; and deletion means for deleting the electrostatic potential image formed by the electrostatic potential image forming means, the developing means, the charging means and the electrostatic potential image forming means being formed into a single detachable cartridge structure signed to be mounted in the image forming apparatus.

Additionally, the above-described object of the present invention is achieved by an image forming method for forming an image by controlling a timing of toner supply, comprising:

a density detecting step for detecting a density of toner in a developer when forming an image;

a toner supply step for supplying toner during image formation in an amount determined by a first toner density detected in the density detecting step and stored in a memory;

an image forming step for forming an image with toner supplied in the toner supply step in accordance with the toner density detected in the density detecting step and stored in the memory; and a storage step for storing in the memory a second toner density detected in the density detecting step in preparation for forming a second image after forming a first image, the toner supply step shutting off power to an image forming apparatus after supply of toner to the image forming apparatus using the second toner density stored in the memory is completed when power to the image forming apparatus is switched OFF.

Preferably, the image forming method is one in which the density detecting step calculates a toner density decrease by determining the amount of toner consumed using a video count that integrates a number of laser drive clock pulses that correspond to a respective plurality of pixel densities of each image to be formed.

Preferably, the image forming method is one in which the image forming step forms an image for each color element, including yellow (Y), magenta (M), cyan (C) and black (Bk).

Additionally, the above-described object of the present invention is also achieved by an image forming program for causing a computer to control toner supply timing and execute an image forming method, the program comprising:

a density detection module for detecting and storing in a memory a first density of a toner in a developer during image formation;

a supply module for using the first toner density detected by the density detection module to adjust an amount of toner to be supplied during one image formation operation executed after the first toner density detected by the density detection module is stored in the memory;

an image formation module that forms an image using the toner supplied by the supply module as adjusted to an optimum toner density; and a storage module for storing a second toner density detected by the density detection module in the memory in preparation for a succeeding image formation operation, the program module causing the computer to shut off power to the image forming apparatus after supply of toner to the image forming apparatus using the second toner density stored in the memory is completed when power to the image forming apparatus is switched OFF.

Additionally, the above-described object of the present invention is also achieved by a computer readable recording medium containing a program module that causes a computer to control toner supply timing and execute an image forming method, the program module comprising:

a density detection module for detecting and storing in a memory a first density of a toner in a developer during image formation;

a supply module for using the first toner density detected by the density detection module to adjust an amount of toner to be supplied during one image formation operation executed after the first toner density detected by the density detection module is stored in the memory;

an image formation module that forms an image using the toner supplied by the supply module as adjusted to an optimum toner density; and a storage module for storing a second toner density detected by the density detection module in the memory in preparation for a succeeding image formation operation, the program module causing the computer to shut off power to the image forming apparatus after supply of toner to the image forming apparatus using the second toner density stored in the memory is completed when power to the image forming apparatus is switched OFF.

Additionally, the above-described object of the present invention is achieved by a computer into which a computer-readable recording medium containing a program module that causes the computer to control toner supply timing and execute an image forming method, the program module comprising:

a density detection module for detecting and storing in a memory a first density of a toner in a developer during image formation;

a supply module for using the first toner density detected by the density detection module to adjust an amount of toner to be supplied during one image formation operation executed after the first toner density detected by the density detection module is stored in the memory;

an image formation module that forms an image using the toner supplied by the supply module as adjusted to an optimum toner density; and a storage module for storing a second toner density detected by the density detection module in the memory in preparation for a succeeding image formation operation, the program module causing the computer to shut off power to the image forming apparatus after supply of toner to the image forming apparatus using the second toner density stored in the memory is completed when power to the image forming apparatus is switched OFF.

Additionally, the above-described object of the present invention is also achieved by an image forming apparatus that uses a developer having a toner and a carrier, the image forming apparatus comprising:

detecting means for detecting an amount of toner consumed during image formation;

mixing means for mixing the toner and the carrier; and toner supply control means for controlling a supply of toner to the mixing means, wherein the toner supply means controls the supply of toner during succeeding image formation operation according to the detected amount of toner consumed during a preceding image formation operation so as to adjust the density of the toner, and when the image forming apparatus is OFF, the toner supply means continuing to supply toner in the absence of an image formation operation using the detected amount of toner consumed during a last image formation operation before the image forming apparatus is actually OFF.

Additionally, the above-described object of the present invention is also achieved by the image forming apparatus as described above, wherein the detecting means detects the amount of toner to be consumed during an image formation operation using an image signal that expresses the image to be formed.

Additionally, the above-described object of the present invention is also achieved by the image forming apparatus as described above, further comprising image forming means for forming an image corresponding to color elements including yellow (Y), magenta (M), cyan (C) and black (Bk) in order to form a color image.

Additionally, the above-described object of the present invention is also achieved by the image forming apparatus as described above, further comprising:

a developer container for containing a two-part developer consisting of a toner and a carrier; and an agitation device for agitating the developer inside the developer container.

Additionally, the above-described object of the present invention is also achieved by the image forming apparatus as described above, further comprising:

an image retention medium designed to retain an electrostatic potential image;

charging means for charging the image retention medium;

developing means including a developing sleeve for holding and transporting the developer mixture containing toner and carrier to a developing unit and developing an electrostatic potential image formed on the image retention medium so as to form a toner image; and deletion means for deleting the toner image, at least the agitation device, the image retention body, the charging means, the developing means and the deleting means being formed into a single detachable cartridge structure designed to be mounted in the image forming apparatus.

Other objects, features and advantages of the present invention besides those discussed above shall be apparent to those skilled in the art from the description of preferred embodiments of the invention that follows, with reference to the accompanying drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail, in accordance with the accompanying drawings.

A detailed description will now be given of an image forming apparatus according to a first embodiment of the present invention, with reference initially to FIG. 5 and FIGS. 6A, 6B, 6C and 6D.

Figure 1:
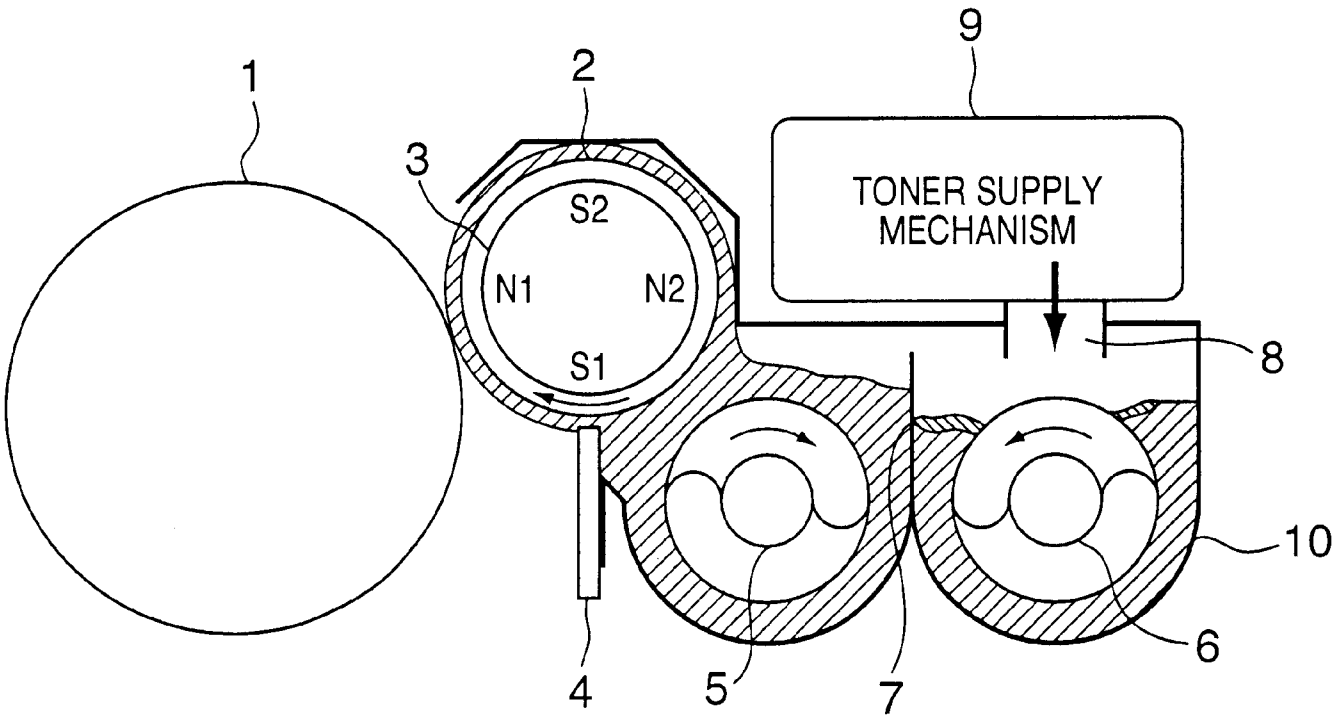
FIG. 1 PRIOR ART
FIG. 1 shows a schematic cross-sectional view of a conventional two-part developing apparatus.
Figure 2:
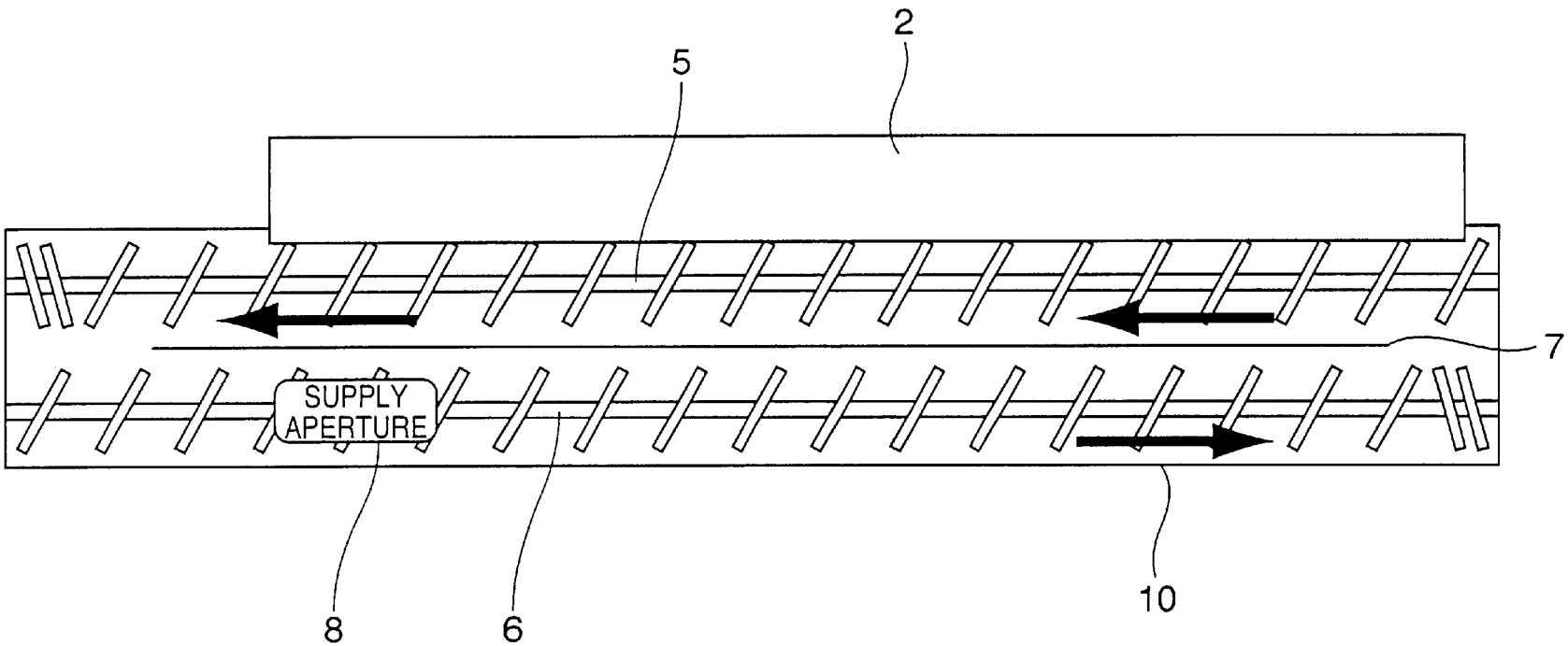
FIG. 2 PRIOR ART
FIG. 2 shows a plan view of a conventional developing apparatus.
Figure 3:
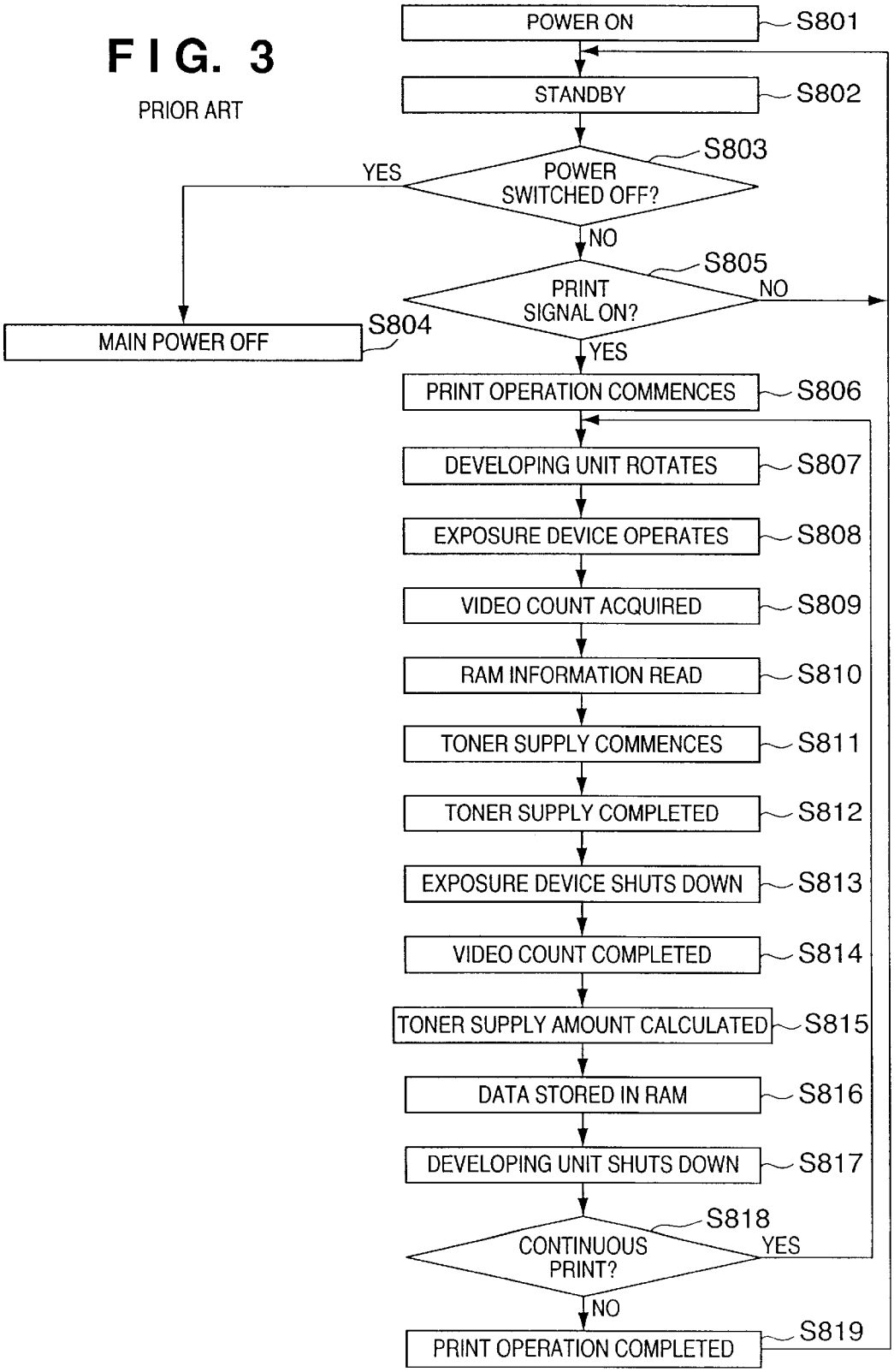
FIG. 3 PRIOR ART
FIG. 3 is a flowchart of steps in a conventional process of video count-based toner supply.
Figure 4:
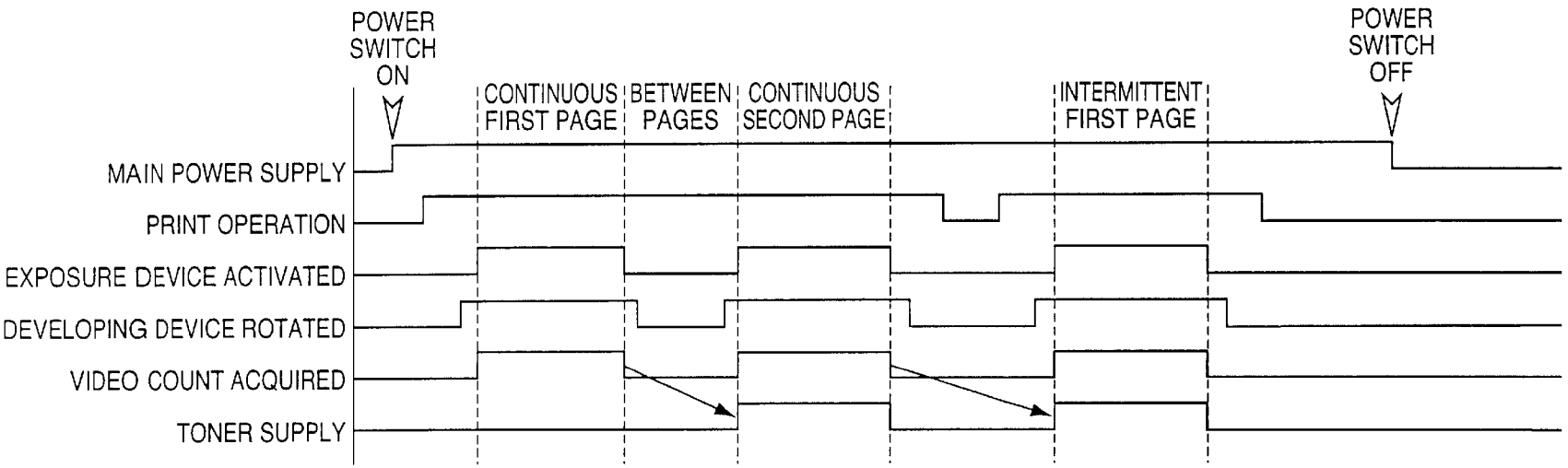
FIG. 4 PRIOR ART
FIG. 4 is a timing chart of steps in a conventional process of video count-based toner supply.
Figure 5:
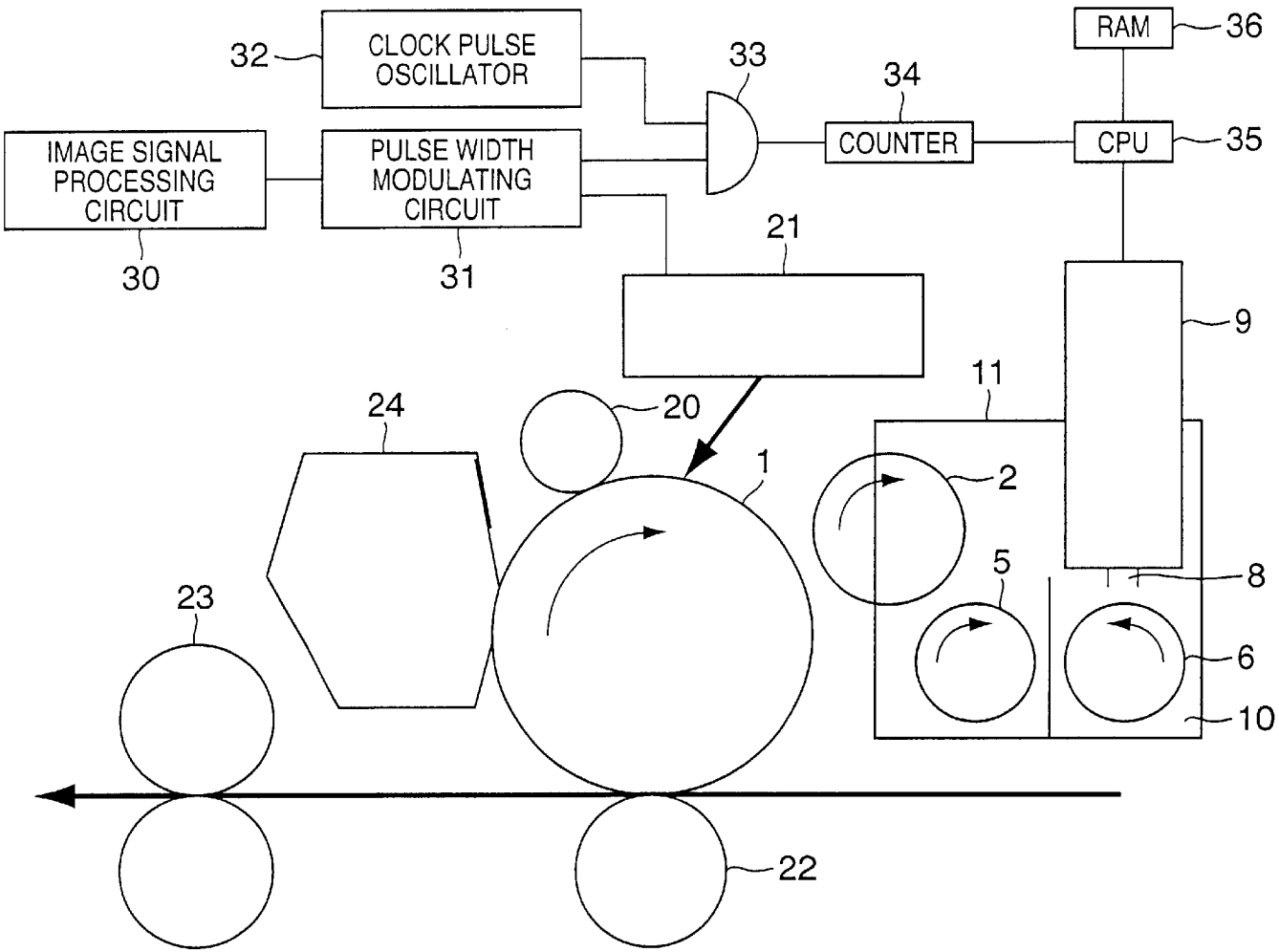
FIG. 5 is a schematic diagram illustrating an image forming apparatus according to a first embodiment of the present invention.

FIG. 5 is a schematic diagram illustrating an image forming apparatus according to a first embodiment of the present invention. Numeral 1 denotes a photosensitive drum that is a potential image retention medium (and corresponds to the image retention medium of the claims), numeral 20 denotes a charging device, numeral 21 denotes an exposure device for forming a potential image on the photosensitive drum 1, numeral 11 denotes a developing device that uses toner to make the potential image visible, numeral 9 denotes a toner supply mechanism for supplying toner to the developing device 11, numeral 22 denotes a transfer device that transfers the visible toner image to a transfer material, numeral 23 denotes a fixing device that fixes the transferred image to the transfer material, and numeral 24 is a cleaning device that deletes toner remaining on the photosensitive drum 1 after image transfer.

The developing device 11 is provided with a developer container 10, which contains a developer in which toner particles and magnetic carrier particles are mixed together. Numeral 10 denotes a developer container. Two agitation devices that are screws A and B are arranged inside the developer container 10. The A screw 5 is disposed substantially parallel to the developing sleeve 2, with B screw 6 disposed on the opposite side of A screw 5, away from the developing sleeve 2. The toner supply mechanism 9 is provided above the B screw 6. The toner supply mechanism 9 contains a supplementary supply of toner (nonmagnetic toner). It should be noted that the toner supply mechanism 9 is provided with a supply aperture 8 at an end nearest the B screw 6. It is through this supply aperture 8 that toner is supplied in amounts sufficient to make up for that which is consumed during the image formation process, the supplementary toner being dropped into the interior of the developer container 10.

Any ordinary product having a binder resin as well as coloring agents and charge control agents may be used as the toner. In the present embodiment, the toner used consists of particles having a diameter of 5 $\mu$m to 15 $\mu$m. It is preferable that a ferrite carrier or a resin-coated matter be used for the magnetic carrier, and it is preferable that the carrier consists of particles having a diameter of 5 $\mu$m to 70 $\mu$m.

An opening is provided on that portion of the developing device 10 nearest the photosensitive drum 1. Into this opening is disposed a developing sleeve denoted by numeral 2. The developing sleeve 2 is a developer retention means, and holds such nonmagnetic materials as aluminum and nonmagnetic stainless steel. The developing sleeve rotates in a direction indicated by the arrow, in such a way as to retain and transport the toner and carrier mixture that is the developer (which mixes toner and carrier) to the developing unit. A developer magnetic brush retained by the developing sleeve 2 then contact the photosensitive drum 1 which is rotated by the developing unit and the electrostatic potential image on the drum 1 is developed.

The development of the electrostatic potential image consumes toner and thus changes the density of the developer inside the developer container, which needs to be replenished in order to maintain the density to develop additional electrostatic potential images satisfactorily. In order to do so, a level of output signals output from the exposure device is counted for each pixel. In the present embodiment, this signal level per pixel count is carried out in the manner described below.

The exposure device 21 may be a laser scanner, equipped with a semiconductor laser, a lens or lens, and a rotating multifaceted mirror that is sometimes also known as a polygon mirror. A laser beam emitted from the semiconductor laser is swept by the polygon mirror and directed onto the photosensitive drum 1 by a fixed mirror. In so doing, the laser beam scans the drum in a main scanning direction that is substantially parallel to the rotational axis of the photosensitive drum 1, thus forming the electrostatic potential image.

The electrostatic potential image thus formed is then fed to a pulse modulation circuit 31 from a personal computer or image input scanner via an image processing circuit 30, which forms a laser drive pulse of a width (time-length) that corresponds to each input pixel image signal level that is then output to the exposure device 21.

Figures 6A, 6B, 6C, 6D:
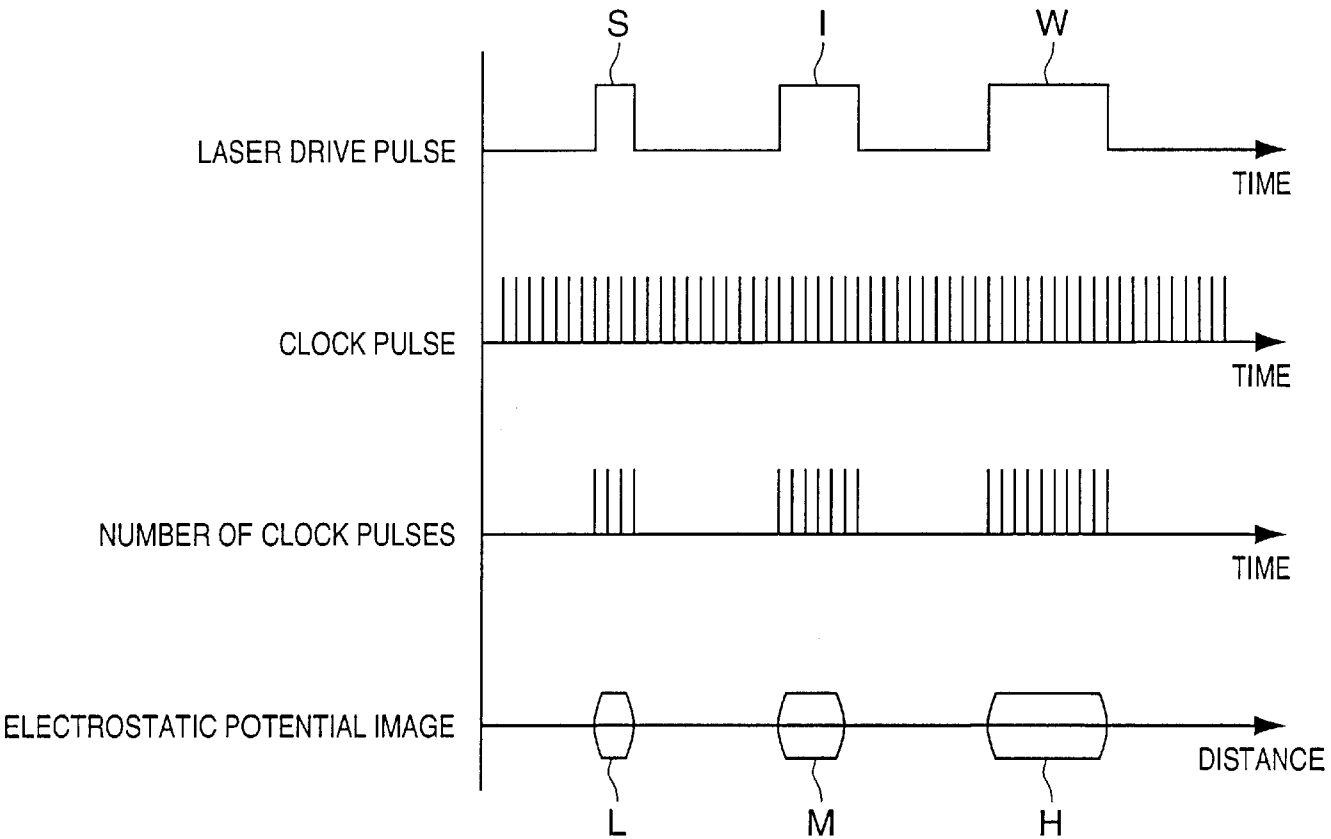
FIGS. 6A, 6B, 6C and 6D are diagrams illustrating a process of calculating a video count in the first embodiment of the present invention

FIGS. 6A, 6B, 6C and 6D are diagrams illustrating a process of calculating a video count in the first embodiment of the present invention. As shown in FIG. 6A the laser drive pulse is given a narrow width S for low-density pixel image signals, a wider width W for high-density pixel image signals and an intermediate width I for intermediate-density pixel image signals.

The laser drive pulse output from the pulse modulation circuit 31 is then supplied to the exposure device 21, causing the exposure device 21 to fire a semiconductor laser having a duration that corresponds precisely to the pulse width. Accordingly, the semiconductor laser fires for a longer period of time for a high-density pixel and for a shorter period of time for a low-density pixel. As a result, the photosensitive drum 1 is subjected to exposure over a longer range in the main scanning direction for a high-density pixel and is subjected to exposure over a shorter range in the main scanning direction for a low-density pixel.

As shown in FIG. 6D, the low-, medium- and high-density pixel electrostatic potential images are denoted as L, M and H, respectively, such that the electrostatic potential image dot size changes depending on the density of the pixel. Accordingly, the amount of toner consumed for a high-density pixel is naturally greater than that for a low-density pixel.

The pulse modulation circuit 31 output signal is supplied to one of the inputs of an AND gate 33, with a clock pulse (shown in FIG. 6B) supplied to the other input of the AND gate 33. Accordingly, as shown in FIG. 6C, the number of clock pulses output from the AND gate 33 differs according to the density of each pixel and corresponds to laser drive pulse widths S, I and W. The number of clock pulses is added by a counter 34 at every image, ultimately to obtain a video count.

The video count corresponds to the amount of toner consumed by the developing unit in order to form the toner image of the output image, and is supplied to a CPU 35 and stored in a RAM 36. The CPU 35 calculates the amount of toner consumed from the developing unit 11 based on the video count and activates the toner supply mechanism 9 for just as long as is needed to replenish the toner in the developer container. Accordingly, a greater video count means that the toner supply mechanism 9 is driven for a longer period of time, while a smaller video count means that the toner supply mechanism 9 is driven for a shorter period of time.

It should be noted that the image forming apparatus of the present embodiment uses a soft switch mechanism. As a result, even when mechanically the power switch is switched to the OFF position the internal power circuit is not physically shut down.

A description will now be given of an operation of an image forming apparatus according to the present embodiment.

Figure 7:
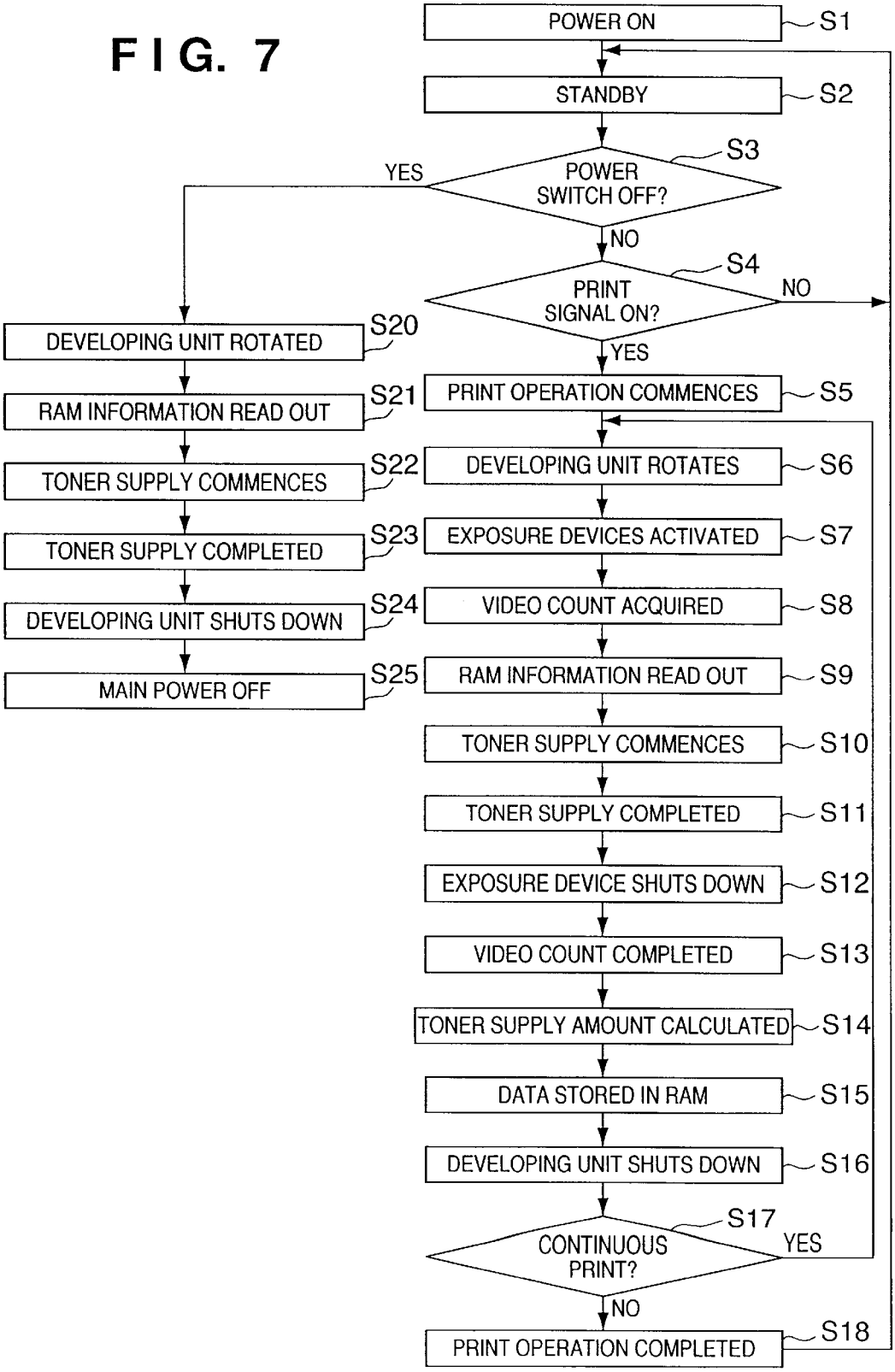
FIG. 7 is a flowchart illustrating steps in a toner supply operation of the image forming apparatus according to a first embodiment of the present invention.
Figure 8:
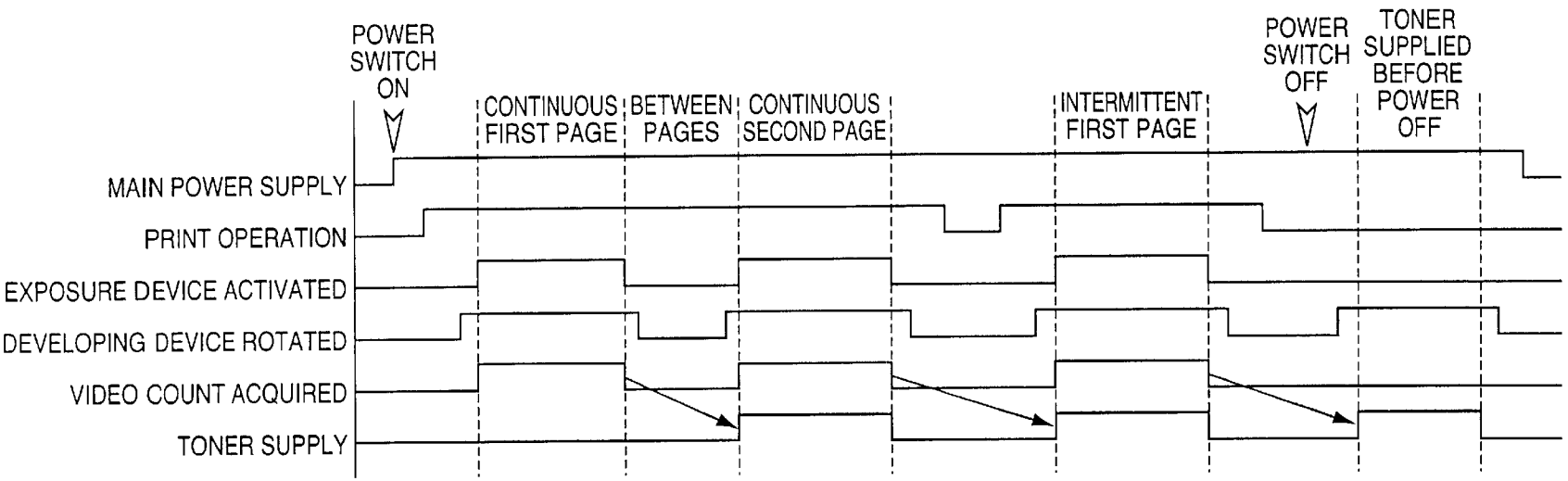
FIG. 8 is a timing chart of the toner supply operation illustrated in FIG. 7.

FIG. 7 is a flowchart illustrating steps in a toner supply operation of the image forming apparatus according to a first embodiment of the present invention. FIG. 8 is a timing chart of the toner supply operation illustrated in FIG. 7.

After the power to the image forming apparatus has been switched ON in a step S1, the image forming apparatus enters a standby mode in a step S2 once a predetermined warm-up has been completed. When a print signal is received in standby mode in a step S4, a printing operation commences and the photosensitive drum 1, the charging device 20 and the exposure device 21 are activated in turn.

As described above, in terms of extending the working life of the developing unit, it is better that the developing unit rotation time be as short as possible, and so the developer is kept static until the time comes to develop an image, at which time only is the developing unit rotated (in a step 86). The screws inside the developing unit rotate simultaneously with the rotation of the developing sleeve, commencing agitation of the developer. The exposure device is then activated as the rotation of the developing unit 11 slows, forming a potential image in a step S7. At the same time, video count data acquisition commences in a step S8.

The CPU 35 then reads the replenished toner amount as calculated at the previous printing and stored in the RAM 36 in a step S9 and, in a step S10, activates the toner supply mechanism 9 and commences toner supply in order to supply the necessary amount of toner. The toner supply operation must be completed while the developer screws are still turning, and so the toner supply operation is set to finish within the time allotted for image formation in a step S11.

When the formation of the potential image is completed the exposure device stops operation in a step S12, and, at the same time, the compilation of the video count is completed in a step S13. The CPU 35 uses the acquired video count to calculate the toner supply amount in a step S14 and to store the toner supply amount data so calculated in the RAM for the succeeding print operation in a step S15. After the potential image has completely passed the developing unit 11, the developing unit 11 stops operation in a step S16. If in a step S17 it is determined that the print is a continuous one, then the image forming apparatus begins the next cycle once more. If, however, it is determined in a step S17 that the print is not continuous, then the print operation temporarily ceases in a step S18 and the image forming apparatus returns to the standby mode of step S2.

When the power to the image forming apparatus is switched OFF in a step S3, then the special toner supply mode activated at such times is activated. That is, when the power is switched OFF in step S3, neither the exposure device 21 nor the charging device 20 are activated yet the developing unit 11 alone is rotated in a step S20.

Next, in a step S21, the CPU 35 reads the toner supply amount calculated during the preceding print operation and stored in the RAM 36 and, in a step S22, commences toner supply. The toner supply amount calculated during the previous printing is calculated in step S14 of FIG. 7, and the toner supply amount data so calculated is stored in the RAM 36 in a step S15. After the correct amount of toner is supplied in a step S23, the developing unit 11 ceases operation in a step S24 and the internal power circuit is shut down, thereby fully shutting down operation of the image forming apparatus.

Accordingly, as described above, when power to the image forming apparatus is switched OFF, the main power supply is shut down only after the special toner supply mode is executed, and as a result the supply of toner is completed before all power is lost, thus ensuring that a supply of toner is ready and available for even a single-sheet printing when power to the image forming apparatus is switched ON once again, thereby avoiding the problems of lack of supply or of undersupply of toner of the conventional art.

Additionally, when power to the image forming apparatus is switched OFF, developer to which toner that should be supplied is in fact supplied post-development is positioned directly below the supply aperture described above, thus providing substantially better toner supply than is the case with conventional toner supply systems. As a result, problems such as no toner being supplied to the developer after development or too much toner being supplied to developer that has hardened overnight into an uneven mass and thereby resulting in uneven charge distribution do not arise.

It should be noted that the image forming apparatus according to the first embodiment of the present invention is described above with reference to a case in which the image forming apparatus is adapted for use in an electrophotography laser printer. However, those of skill in the art can appreciate that the image forming apparatus and image forming method of the present invention is equally adaptable to a variety of image forming apparatuses, such as copiers and printers employing a variety of systems, such as electro photography and electrostatic recording. Moreover, a variety of variations and modifications to the image forming apparatus and the control systems of the present invention can be undertaken which are nevertheless still within the scope and spirit of the present invention.

A description will now be given of a second embodiment of the present invention, with reference to the drawings.

Figure 9:
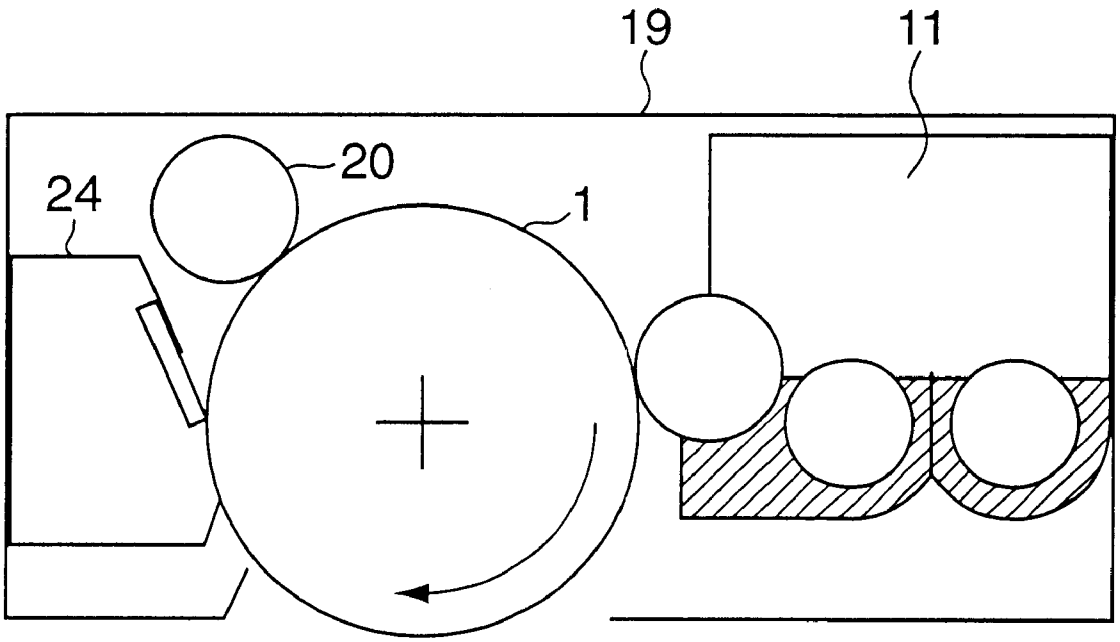
FIG. 9 is a schematic cross-sectional view of a detachable process cartridge mounted in an image forming apparatus according to a second embodiment of the present invention.
Figure 10:
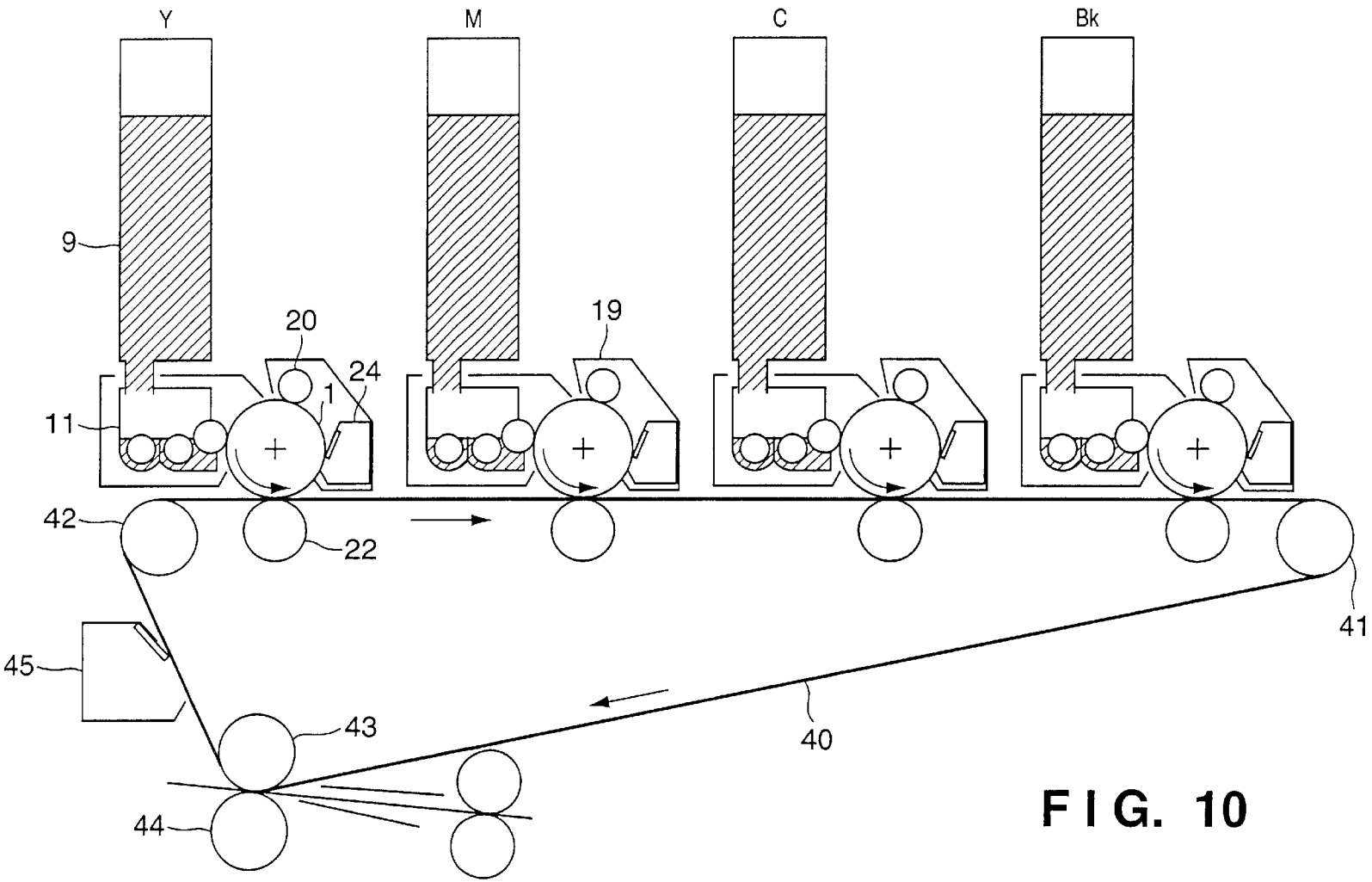
FIG. 10 is a schematic cross-sectional view of a color image forming apparatus according to a second embodiment of the present invention, specifically a color laser printer employing an electro photography process.

FIG. 9 is a schematic cross-sectional view of a detachable process cartridge mounted in an image forming apparatus according to a second embodiment of the present invention. FIG. 10 is a schematic cross-sectional view of a color image forming apparatus according to a second embodiment of the present invention, specifically a color laser printer employing an electrophotography process.

The second embodiment of the present invention involves a color image forming apparatus mounting a plurality of process cartridges, in which the operations of the first embodiment described above are employed.

As shown in FIG. 9, a process cartridge 19 forms a single unit out of a developing apparatus 11, photosensitive drum 1 that acts as a potential image retention body, a charge roller 20 that is a charging device and a cleaning device 24, the entire single unit being detachable mounted in the image forming apparatus.

In this case as well, the effects of the first embodiment can be achieved, and at the same time, the use of the process cartridge means that when the power is switched OFF the entire cartridge can be extracted and the constituent parts replaced easily. Accordingly, the serviceability of the image forming apparatus is vastly improved over the conventional art. Additionally, replacing the cartridge means that the important constituent parts of the electro photography are replaced with new components, thus maintaining the quality of the image.

The color laser printer shown in FIG. 10 has a plurality of process cartridges 19, and is a four continuous drum-type (in-line) printer that obtains full color print images by continuous multiple transfer to an intermediate transfer belt 40 that is a second image retention body.

The endless intermediate transfer belt 40 of FIG. 10 is strung between a drive roller 41, a tension roller 42 and a secondary transfer opposed rollers 43, 44, and runs in a direction indicated by the arrow in the diagram. The process cartridge 19 is really four cartridges disposed serially with respect to the above-described intermediate transfer belt 40 and corresponding to the four colors Y, M, C and Bk.

The photosensitive drum 1 is disposed within the process cartridge 19 and develops the yellow tuner. As the photosensitive drum 1 rotates, the photosensitive drum 1 is given a predetermined polarity and electric potential by the primary charge roller 20 and then subjected to an image exposure from an image exposure means not shown in the diagram (such as a color original image color resolution and imaging exposure optical system, a scan exposure system produced by a laser scan that outputs a laser beam that is modulated according to image information time sequence electrical digital pixel signals, and the like) to form an electrostatic potential image that corresponds to the yellow component image of the target color image. Next, that electrostatic potential image is then developed by a first developing unit (yellow developing unit) and then bias transferred atop the transfer belt.

In this manner, images in the colors yellow (Y), magenta (M), cyan (C) and black (Bk) are successively stacked on the intermediate transfer image 40 until a full color image is formed.

The full four-color image thus formed on the intermediate transfer medium 40 is then transferred to the transfer material by the secondary transfer roller 44 and fused thereto by an adhesive device not shown in the diagram to obtain the final color print image. The secondary transfer toner that still remains on the intermediate transfer belt 40 is scraped clean by an intermediate transfer belt cleaner 45 and readied for the next imaging process.

In such a color image forming apparatus, the same effect can be achieved as described above with respect to the first embodiment, in which a special toner supply mode is executed after the power to the image forming apparatus is switched OFF.

Particularly in the case of a color image forming apparatus, spattering, retransferred toner and inadequate cleaning can cause toner to get mixed into the developing unit of a different color, changing the tone of the entire image. In order to continuously prevent such an occurrence, it is necessary to keep the rotation time of the developing sleeve to a minimum. In the structure of the second embodiment as described above, the supply of toner is replenished once just prior to the power being cut off, and not between pages or during a succeeding rotation. As a result, the rotation of the developing sleeve can be reduced to an absolute minimum, which is very useful for color image forming apparatuses as well.

In the above-mentioned embodiments, though toner density in the developing device is indirectly detected from the consumption of toner, toner density in the developing device is also directly detectable using optical sensors and another detection means, such as a photo-interrupter.

A description will now be given of additional embodiments of the image forming apparatus and image forming method of the present invention.

As can be appreciated by those of skill in the art, the present invention may be adapted to a system comprising a plurality of devices. The plurality of devices may for example include a host computer, interface devices, readers, printers and the like. Additionally, the present invention may also be adapted to an apparatus comprising a single device, such as, for example, a copier, a facsimile machine or the like.

Additionally, as can be appreciated by those of skill in the art, the object of the present invention may also be achieved by supplying a recording medium on which is recorded a software program code for achieving the effects of the above-described embodiments to a system or an apparatus and having a computer, CPU or MPU of such system or apparatus read and execute the program code stored on the recording medium.

In such a case, the program code itself, which is read from the recording medium, achieves the effects of the above-described embodiments, such that the recording medium that records the program code constitutes the present invention.

Additionally, as can be appreciated by those of skill in the art, a case in which the execution of the program code read by the computer not only achieves the effects of the embodiments as described above but also carries out some or all of the actual processes of the operating system (OS) installed in the computer based on the instructions of that program code so as to achieve the functions of the embodiments described above is also included within the scope and spirit of the present invention.

Additionally, as can be appreciated by those of skill in the art, a computer programmed by the program code to achieve the effects of the embodiments described above is also included within the scope and spirit of the present invention, insofar as the reading of the program code from the recording medium on which the program code is recorded by a general-purpose computer transforms that computer into a special-purpose computer, such special-purpose computer being one embodiment of the present invention.

Additionally, as can be appreciated by those of skill in the art, a case in which a computer, CPU or the like, based on the instructions of the program code read from the recording medium after the program code has been written to a memory of a function expansion card which is designed to be inserted into the computer, CPU or the like or a memory of a function expansion unit which is designed to be connected to the computer, CPU or the like, carries out some or all of the actual processes so as to achieve the effects of the embodiments described above is also included within the scope and spirit of the present invention.

In the event that the present invention is adapted to the above-described recording medium, a program code that executes a process that corresponds to the flowchart described above with reference to FIG. 7 is stored on such recording medium.

As described above, according to the image forming apparatus of the present invention, the supply of toner necessary for a succeeding image formation operation can be completed before the power to the image forming apparatus is switched OFF, so that the problem of no toner being supplied or inadequate amounts of toner being supplied when the power to the image forming apparatus is switched on again can be prevented.

By completing the supply of toner needed for the succeeding image formation operation just prior to the power being switched OFF, the continuity of the toner supply can be ensured through repeated switching of the power on and off, thus enabling the toner density to be maintained at a consistent level.

As many apparently widely different embodiments of the present invention can be made without departing from the spirit and scope thereof, it is to be understood that the invention is not limited to the specific embodiments thereof except as defined in the claims.

What is claimed is:

1. An image forming apparatus for controlling a toner supply, comprising:

density detecting means for detecting a density of toner in a developer when forming an image;

toner supply means for supplying toner during image formation in an amount determined by a first toner density detected by the density detecting means and stored in a memory;

image forming means for forming an image with toner supplied from the toner supply means in accordance with the toner density detected by the density detecting means and stored in the memory; and storage means for storing in the memory a second toner density detected by the density detecting means in preparation for forming a second image after forming a first image, wherein the toner supply means shutting off power to the image forming apparatus after supply of toner to the image forming apparatus using the second toner density stored in the memory is completed when power to the image forming apparatus is switched OFF.

2. The image forming apparatus according to claim 1, wherein the density detecting means calculates a toner density decrease by determining the amount of toner consumed using a video count that integrates a number of laser drive clock pulses that correspond to a respective plurality of pixel densities of each image to be formed.

3. The image forming apparatus according to claim 1, wherein the image forming means forms an image corresponding to color elements including yellow (Y), magenta (M), cyan (C) and black (Bk) in order to form a color image.

4. The image forming apparatus according to claim 1, wherein the image forming means comprises:

an electrostatic potential image forming means for forming an electrostatic potential image, the electrostatic potential image forming means comprising:

charging means for charging the electrostatic potential image forming means so as to form the electrostatic potential image; and developing means comprising:

a developer container for containing a two-part developer consisting of a toner and a carrier;

an agitation device for agitating the developer inside the developer container; and a developer sleeve for holding and transporting the agitated developer to a developing unit; and deletion means for deleting the electrostatic potential image formed by the electrostatic potential image forming means, the developing means, the charging means and the electrostatic potential image forming means being formed into a single detachable cartridge structure signed to be mounted in the image forming apparatus.

5. An image forming method for forming an image by controlling a timing of toner supply, comprising:

a density detecting step for detecting a density of toner in a developer when forming an image;

a toner supply step for supplying toner during image formation in an amount determined by a first toner density detected in the density detecting step and stored in a memory;

an image forming step for forming an image with toner supplied in the toner supply step in accordance with the toner density detected in the density detecting step and stored in the memory; and a storage step for storing in the memory a second toner density detected in the density detecting step in preparation for forming a second image after forming a first image, wherein the toner supply step shutting off power to an image forming apparatus after supply of toner to the image forming apparatus using the second toner density stored in the memory is completed when power to the image forming apparatus is switched OFF.

6. The image forming method according to claim 5, wherein the density detecting step calculates a toner density decrease by determining the amount of toner consumed using a video count that integrates a number of laser drive clock pulses that correspond to a respective plurality of pixel densities of each image to be formed.

7. The image forming method according to claim 5, wherein the image forming step forms an image for each color element, including yellow (Y), magenta (M), cyan (C) and black (Bk).

8. An image forming program for causing a computer to control toner supply timing and execute an image forming method, the program comprising:

a density detection module for detecting and storing in a memory a first density of a toner in a developer during image formation;

a supply module for using the first toner density detected by the density detection module to adjust an amount of toner to be supplied during one image formation operation executed after the first toner density detected by the density detection module is stored in the memory;

an image formation module that forms an image using the toner supplied by the supply module as adjusted to an optimum toner density; and a storage module for storing a second toner density detected by the density detection module in the memory in preparation for a succeeding image formation operation, wherein the program module causing the computer to shut off power to the image forming apparatus after supply of toner to the image forming apparatus using the second toner density stored in the memory is completed when power to the image forming apparatus is switched OFF.

9. A computer readable recording medium containing a program module that causes a computer to control toner supply timing and execute an image forming method, the program module comprising:

a density detection module for detecting and storing in a memory a first density of a toner in a developer during image formation;

a supply module for using the first toner density detected by the density detection module to adjust an amount of toner to be supplied during one image formation operation executed after the first toner density detected by the density detection module is stored in the memory;

an image formation module that forms an image using the toner supplied by the supply module as adjusted to an optimum toner density; and a storage module for storing a second toner density detected by the density detection module in the memory in preparation for a succeeding image formation operation, wherein the program module causing the computer to shut off power to the image forming apparatus after supply of toner to the image forming apparatus using the second toner density stored in the memory is completed when power to the image forming apparatus is switched OFF.

10. A computer into which a computer-readable recording medium containing a program module that causes the computer to control toner supply timing and execute an image forming method, the program module comprising:

a density detection module for detecting and storing in a memory a first density of a toner in a developer during image formation;

a supply module for using the first toner density detected by the density detection module to adjust an amount of toner to be supplied during one image formation operation executed after the first toner density detected by the density detection module is stored in the memory;

an image formation module that forms an image using the toner supplied by the supply module as adjusted to an optimum toner density; and a storage module for storing a second toner density detected by the density detection module in the memory in preparation for a succeeding image formation operation, wherein the program module causing the computer to shut off power to the image forming apparatus after supply of toner to the image forming apparatus using the second toner density stored in the memory is completed when power to the image forming apparatus is switched OFF.

11. An image forming apparatus that uses a developer having a toner and a carrier, the image forming apparatus comprising:

detecting means for detecting an amount of toner consumed during image formation;

mixing means for mixing the toner and the carrier; and toner supply control means for controlling a supply of toner to the mixing means, wherein the toner supply means controls the supply of toner during a succeeding image formation operation according to the detected amount of toner consumed during a preceding image formation operation so as to adjust the density of the toner, and when the image forming apparatus is in an all-power OFF state, the toner supply means continuing to supply toner in the absence of an image formation operation using the detected amount of toner consumed during a last image formation operation before the image forming apparatus is in an all-power OFF state.

12. The image forming apparatus according to claim 11, wherein the detecting means detects the amount of toner to be consumed during an image formation operation using an image signal that expresses the image to be formed.

13. The image forming apparatus according to claim 11, further comprising image forming means for forming an image corresponding to color elements including yellow (Y), magenta (M), cyan (C) and black (Bk) in order to form a color image.

14. The image forming apparatus according to claim 11, further comprising:

a developer container for containing a two-part developer consisting of a toner and a carrier; and an agitation device for agitating the developer inside the developer container.

15. The image forming apparatus according to claim 11, further comprising:

an image retention medium designed to retain an electrostatic potential image;

charging means for charging the image retention medium;

developing means including a developing sleeve for holding and transporting the developer mixture containing toner and carrier to a developing unit and developing an electrostatic potential image formed on the image retention medium so as to form a toner image; and deletion means for deleting the toner image, at least the agitation device, the image retention body, the charging means, the developing means and the deleting means being formed into a single detachable cartridge structure designed to be mounted in the image forming apparatus.

16. An image forming apparatus that uses a developer having a toner and a carrier, the image forming apparatus comprising:

a detecting unit configured to detect an amount of toner consumed during image formation;

a mixing unit configured to mix the toner and the carrier; and a toner supply control unit configured to control a supply of toner to the mixing unit, wherein the toner supply control unit controls the supply of toner during a succeeding image formation operation according to the detected amount of toner consumed during a preceding image formation operation so as to adjust the density of the toner, and when the image forming apparatus is in an all-power-OFF state, the toner supply control unit continues to supply toner in the absence of an image formation operation using the detected amount of toner consumed during a last image formation operation before the image forming apparatus is in an all-power OFF state.

17. The image forming apparatus according to claim 16, wherein the detecting unit detects the amount of toner to be consumed during an image formation operation using an image signal that expresses the image to be formed.

18. The image forming apparatus according to claim 16, further comprising an image forming unit configured to form an image corresponding to color elements including yellow (Y), magenta (M), cyan (C) and black (Bk) in order to form a color image.

19. The image forming apparatus according to claim 16, further comprising:

a developer container for containing a two-part developer consisting of a toner and a carrier; and an agitation device for agitating the developer inside the developer container.

20. The image forming apparatus according to claim 16, further comprising:

an image retention medium designed to retain an electrostatic potential image;

a charging unit configured to charge the image retention medium;

a developing unit configured to include a developing sleeve for holding and transporting the developer mixture containing toner and carrier to a developing unit and developing an electrostatic potential image formed on the image retention medium so as to form a toner image; and a deletion unit configured to delete the toner image, wherein the image retention medium, the charging unit, the developing unit, and the deleting unit are formed into a single detachable cartridge structure designed to be mounted in the image forming apparatus.

* * * * *

UNITED STATES PATENT AND TRADEMARK OFFICE

CERTIFICATE OF CORRECTION

PATENT NO. : 6,708,007 B2
DATED : March 16, 2004
INVENTOR(S) : Seiji Yamaguchi

It is certified that error appears in the above-identified patent and that said Letters Patent is hereby corrected as shown below:

Column 1,
Line 37, “is” should be deleted.

Column 2,
Line 23, “is” (first occurrence) should be deleted.

Column 4,
Line 59, “the” (first occurrence) should read -- wherein the --.

Column 5,
Line 28, “signed” should read -- designed --; and
Line 49, “the” should read -- wherein the --.

Column 6,
Line 16, “the” (first occurrence) should read -- wherein the --; and
Line 41, “the” (first occurrence) should read -- wherein the --.

Column 7,
Line 1, “the” (first occurrence) should read -- wherein the --.

Column 8,
Line 20, “invention” should read -- invention; --; and
Line 34, “electro photography” should read -- electrophotography --.

Column 9,
Line 18, “consists” should read -- consist --;
Line 30, “contact” should read -- contacts --; and
Line 43, “lens,” should read -- lenses, --.

Column 11,
Line 67, “is” should read -- are --.

Column 12,
Line 2, “electro” should read -- electro- --;
Line 24, “detachable” should read -- detachably --; and
Line 31, “electro photography” should read -- electrophotography --.

UNITED STATES PATENT AND TRADEMARK OFFICE

CERTIFICATE OF CORRECTION

PATENT NO. : 6,708,007 B2
DATED : March 16, 2004
INVENTOR(S) : Seiji Yamaguchi

It is certified that error appears in the above-identified patent and that said Letters Patent is hereby corrected as shown below:

Column 15,
Line 28, "signed" should read -- designed --.

Signed and Sealed this

Seventeenth Day of August, 2004

JON W. DUDAS
*Acting Director of the United States Patent and Trademark Office*